US006454932B1

(12) United States Patent
Baldassari et al.

(10) Patent No.: US 6,454,932 B1
(45) Date of Patent: Sep. 24, 2002

(54) MULTIPLE STAGE EBULLATING BED HYDROCRACKING WITH INTERSTAGE STRIPPING AND SEPARATING

(75) Inventors: Mario C. Baldassari, Westwood, NJ (US); Wai Seung Louie, Brooklyn, NY (US); Ujjal Kumar Mukherjee, Montclair, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 09/638,375

(22) Filed: Aug. 15, 2000

(51) Int. Cl.[7] ..... C10G 65/02
(52) U.S. Cl. ..... 208/59; 208/58; 208/153
(58) Field of Search ..... 208/58, 59, 153

(56) References Cited

U.S. PATENT DOCUMENTS 3,215,617 A * 11/1965 Burch et al. ..... 208/59
3,267,021 A * 8/1966 Gould ..... 208/78
3,412,010 A * 11/1968 Alpert et al. ..... 208/112
3,418,234 A * 12/1968 Chervenak et al. ..... 208/59
3,788,973 A * 1/1974 Wolk et al. ..... 208/59
3,844,933 A * 10/1974 Wolk et al. ..... 208/59
3,887,455 A * 6/1975 Hamner et al. ..... 208/112
3,893,911 A * 7/1975 Rovesti et al. ..... 208/251 H
3,963,600 A * 6/1976 Hilfman ..... 208/59
3,974,060 A * 8/1976 Voorhies, Jr. et al. ..... 208/59
4,058,449 A * 11/1977 Reitz et al. ..... 208/59
4,411,768 A * 10/1983 Unger et al. ..... 208/59
4,457,831 A * 7/1984 Gendler ..... 208/59
4,521,295 A * 6/1985 Chervenak et al. ..... 208/59
RE32,265 E * 10/1986 Unger et al. ..... 208/59
4,657,665 A * 4/1987 Beaton et al. ..... 208/216 R
4,746,419 A * 5/1988 Peck et al. ..... 208/213
6,217,746 B1 * 4/2001 Thakkar et al. ..... 208/59

* cited by examiner

*Primary Examiner*—Nadine Preisch
(74) *Attorney, Agent, or Firm*—Alix, Yale & Ristas, LLP

(57) ABSTRACT

High boiling hydrocarbon materials are hydrocracked in a multiple stage process having ebullating catalyst bed hydrogenation reactor stages in series. Between the hydrogenation reactors is an interstage separator/stripper to separate a vapor phase and to strip the liquid phase with hydrogen to produce a heavier, more concentrated liquid phase as the feed to the next ebullating bed reactor stage in the series. The feed to the second stage may be blended with an aromatic solvent and/or a portion of the high boiling hydrocarbon feedstock.

4 Claims, 1 Drawing Sheet

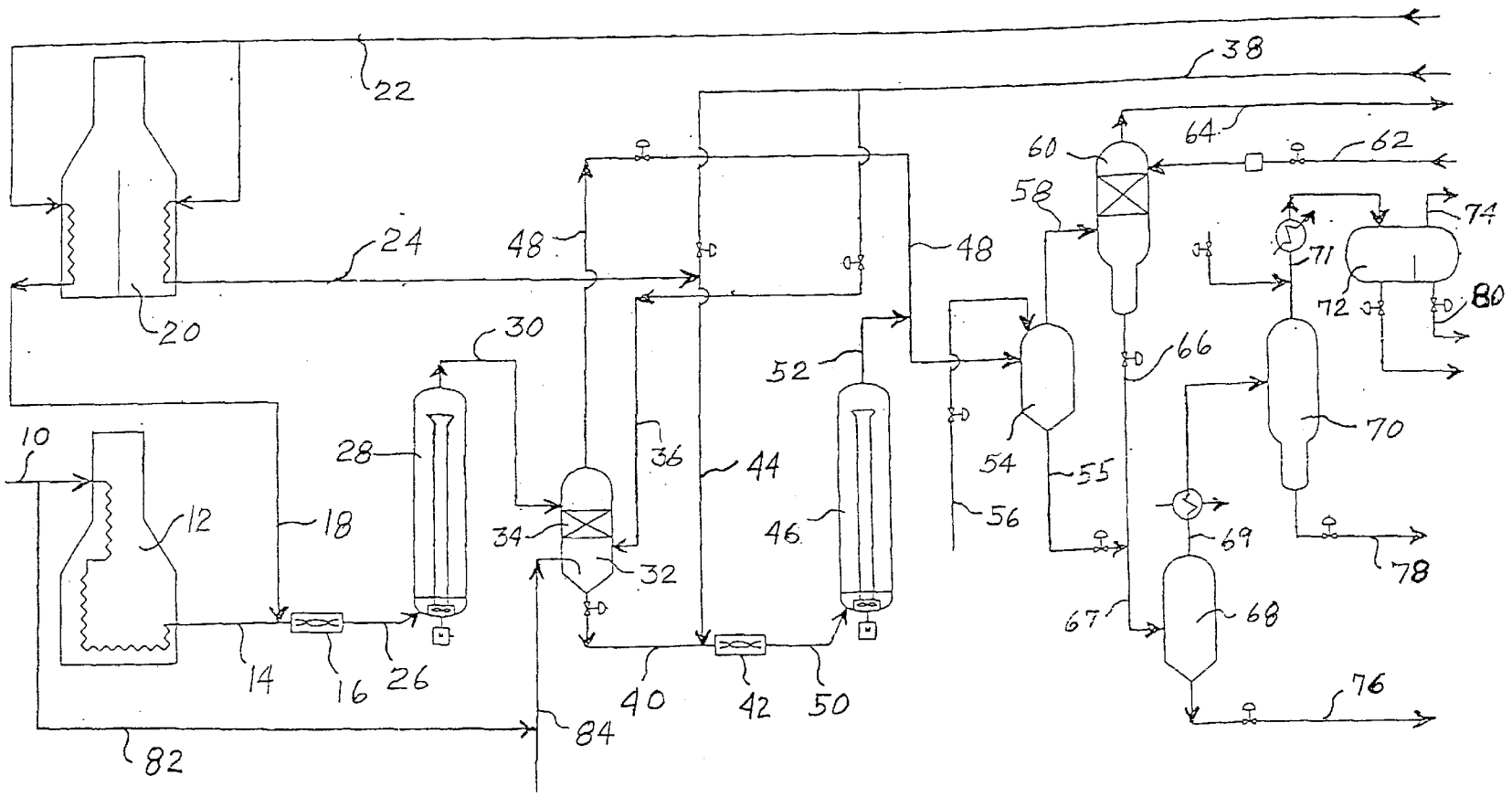
10
12
14
16
18
20
22
24
26
28
30
32
34
36
38
40
42
44
46
48
50
52
54
55
56
58
60
62
64
66
67
68
69
70
71
72
74
76
78
80
82
84

MULTIPLE STAGE EBULLATING BED HYDROCRACKING WITH INTERSTAGE STRIPPING AND SEPARATING

BACKGROUND OF THE INVENTION

This invention relates to hydrocracking and more particularly to the hydrocracking of high boiling hydrocarbon materials to provide valuable lower boiling materials.

High boiling hydrocarbon materials derived from petroleum, coal or tar sand sources, usually petroleum residuum or solvent refined coal, are typically hydrocracked in ebullated (expanded) catalyst bed reactors in order to produce move valuable lower boiling materials such as transportation fuels or lubricating oils. In order to obtain a desired degree of hydrogenation for hydrocracking and hydrotreating, there are typically several ebullating bed reactors in series. As an example, see U.S. Pat. No. 4,411,768. In order to increase the capacity of such a system, it is necessary to increase the diameter of each of the reactors consistent with the higher treat gas rates to process this higher liquid capacity. Also, typically, all of the liquid and gaseous products from the first reactor are sent to the second reactor. As a result for a given treat gas rate: (1) the hydrogen partial pressure declines due to production of light hydrocarbon vapors from the cracking of the heavier liquid fractions and (2) the concentration of lighter and typically more paraffinic liquid components increases with increasing residuum conversion. This reduction in hydrogen partial pressure and increase in concentration of lighter more paraffinic constituents results in an increase in sediment formation, limiting the residuum conversion level which can be attained based on either product quality or reactor operability constraints.

SUMMARY OF THE INVENTION

The object of the present invention is to increase the conversion levels in an ebullating catalyst bed hydrogenation process with a plurality of ebullating bed reactors in series. The invention involves a stripping and separation step between the serial ebullating bed reactors to strip the liquid with hydrogen and separate the lighter components and feed only the remaining liquid to the next ebullating bed reactor.

BRIEF DESCRIPTION OF THE DRAWING

The drawing is a process flow diagram illustrating the process of the present invention.

DETAILED DESCRIPTION OF THE INVENTION

Referring to the drawing, a heavy, high boiling feed 10 is heated in feed heater 12 to the temperature required for the catalytic hydrogenation reaction, usually in the range from 650° F. to 725° F. The heated feed 14, primarily components boiling above 975° F., is combined in the feed mixer 16 with a hydrogen-rich stream 18 which has been heated in the hydrogen heater 20 to a temperature typically ranging from 650° F. to 1025° F. This hydrogen-rich stream 18 represents a portion of the total hydrogen-rich gas stream 22 composed of purified recycle gas or make-up hydrogen or a combination of both. The other portion 24 of the recycle gas stream 22, which is also heated at 20, is fed to the second ebullating catalyst bed reactor as will be described later.

The heated mixture 26 of hydrogen and feed material is introduced into the bottom of the ebullating catalyst bed reactor 28. Such reactors containing an expanded bed of hydrogenation catalyst are well known in the art. The hydrogenation catalysts suitable for hydrocracking and hydrotreating heavy, high boiling hydrocarbons are also well known and include but are not limited to nickel-molybdate, cobalt-molybdate and cobalt-nickel-molybdate with these catalyst materials typically carried on supports such as alumina and silica-alumina. A typical operating temperature for the reactor 28 is in the range of 750 to 840° F.

The effluent 30 from the reactor 28 contains the partially converted materials having a boiling range from less than 350° F. to over 975° F. The nature of this stream 30 is typically as follows:

| Fraction | Boiling Range | Wt. % |
|---|---|---|
| Unconverted heavy oil | 975° F.+ | 35–70% |
| Vacuum gas oil | 650–975° F. | 20–60% |
| Atmospheric gas oil | 350–650° F. | 5–20% |
| Naphtha | 350° F.– | 1–5% |

This stream 30 is fed to the interstage separator/stripper 32 containing a liquid/vapor contact section 34. The vapor and liquid in stream 30 are separated in the top section of the interstage separator/stripper and the downflowing liquid is stripped of the lighter hydrocracking products by contacting the liquid with hydrogen-rich gas stream 36. This stream is typically derived from purified recycle gas and/or make-up hydrogen. The stripping gas rate may be in the range of 300 to 1500 standard cubic feet per barrel of liquid feed. The temperature may be in the range of 750 to 840° F. and the pressure in the range of 1500 to 3000 psig. The remaining liquid 40 from the bottom of the separator/stripper 32 is mixed at 42 with hydrogen-rich gas stream 44, a portion of which has been heated in 20, typically to 650° F. to 1025° F., with the remainder supplied at a temperature of between 200° F. to 650° F. This mixture is then sent to the second ebullating catalyst bed reactor 46. The vapor 48, from flashing and stripping the first reactor effluent, is bypassed around this second reactor. By stripping the lighter products from the liquid effluent in stream 30 from the first reactor, the liquid feed to the second reactor 46 is reduced. Also, the light ends ($C_4$-) dissolved in the liquid are reduced as are the lower boiling hydrocarbon fractions (typically 650° F.–). As a result, (1) for a given reactor volume and temperature, the residuum conversion is increased due to the reduced liquid throughput, (2) the hydrogen partial pressure is increased due to the stripout of light ends and the lighter boiling hydrocarbon fractions and (3) the concentration of lighter boiling more paraffinic hydrocarbon fractions in the second ebullating bed reactor is reduced.

As a result, due to the increased hydrogen partial pressure and reduced concentration of the lighter more paraffinic hydrocarbon fractions, the sediment formation, as typically measured by the Shell Hot Filtration Test (SMS-2696), is reduced, enabling residuum conversion levels to be increased while satisfying residuum product sediment specifications and remaining within reactor operability limits.

The feed 50 to the second reactor 46 undergoes further hydrocracking in this reactor producing the effluent 52 which is combined with the vapors 48 from the separator/stripper 32 and fed to the high pressure separator 54 along with quench oil 56, if required, to reduce the temperature and coking tendency of the liquid. Depending on the application, the vapor 58 from the separator may then be fed to a wash tower 60 where it is contacted with wash oil 62, typically having a boiling range of 500° F. to 975° F. The wash oil 62 could either be derived internally from the process or supplied externally from other refinery process units. The resulting vapor product 64 from the wash tower 60 is typically cooled 30° F. to 50° F. by contact with the wash oil 62. As a result, entrainment of residuum plus the content of residuum boiling fractions (975° F.+), in equilibrium with the liquid phase, in stream 64 is significantly reduced. The liquid 66 from the wash tower 60 composed of remaining unvaporized constituents of the wash oil 62 plus residuum removed from stream 58 is combined with the liquid 55 from separator 54 containing unconverted residuum plus lighter boiling fractions resulting from conversion of the residuum in reactors 28 and 46. This combined heavy oil liquid stream 67 is then flashed in the heavy oil flash drum 68. The resulting flashed vapor 69 is then cooled by heat exchange. The cooled stream is then flashed at 70. The flashed vapor 71 is again cooled and further flashed at 72 to produce a cooled hydrogen-rich vapor 74 which is typically recycled after further purification. The hydrocarbon liquids recovered from cooling the vapor streams and flashing are collected in the flash drums 70 and 72. The resulting liquid products from flashing including the heavy oil 76 including the liquids 78 and 80 as well as liquid recovered from the vapor 64 are typically combined and processed downstream such as by fractionation.

In a system where there are more than two ebullating bed reactors in series, an interstage reactor/stripper may be located between each pair of reactors in the series. Additionally, a portion 82 of the heavy high boiling feed 10, and/or all or a portion of a heavy aromatic stream 84 can be introduced directly into the second reactor 46 by blending the stripped liquid from the interstage separator/stripper 32, thereby bypassing the first reactor 28. This has a three-fold purpose. Firstly, the liquid introduced into the interstage separator/stripper acts to quench the liquid pool in the bottom of this vessel, thereby reducing the coking tendency of the fluid. Secondly, the introduction of aromatic solvent directly into the second reactor, which operates at the highest severity and residuum conversion level, acts to limit the sediment formation compared with the usual commercial practice where all of this aromatic solvent is introduced into the first reactor. As a result, for a given quantity of aromatic solvent, the preferential introduction of this solvent into the second reactor will extend the residuum conversion level at which the unit can be operated. Thirdly, the injection of a portion of the heavy high boiling feed directly into the second reactor, via the interstage separator/stripper, also acts to reduce sediment formation, allowing residuum conversion levels to be increased by increasing the resin to asphaltene concentration ratio in the liquid phase in the second reactor.

The benefits of the invention are as follows:

1) By separating the first reactor vapor/liquid effluent and by further stripping the liquid in an interstage separator/stripper (a) the vapor rate to the second reactor is reduced 30 to 40% and (b) the liquid rate to the second reactor is reduced 6–15%. As a result, based on the maximum allowable gas superficial velocity commensurate with achieving the required disengagement of gas from the recirculated liquid in the reactor recycle pan, the liquid throughput for a given reactor cross-sectional area can be increased 30 to 40% based on the reduction in vapor rate to the second reactor. Alternatively, for a fixed cross-sectional area, the reduction in vapor rate results in a reduction of 10–15% in the gas hold-up in the second reactor, thereby reducing the overall reactor volume needed to achieve a desired residuum conversion by 12 to 15%. Further, the reduction in the liquid rate as a result of stripping the first stage reactor liquid effluent further reduces the overall reactor volume needed to achieve a desired residuum conversion by an additional 3 to 7.5%. The cumulative effect of separating the vapor and liquid and stripping the separated liquid reduces the total required reactor volume by 15 to 22.5% for a given level of residuum conversion. Alternatively, for a given reactor, volume residuum conversion can be increased 5 to 8%.

2) By stripping the first stage reactor effluent liquid, the concentration of light ends, including $N_2$, Ar, $H_2S$, $NH_3$, $C_1$, $C_2$'s, $C_3$'s and $C_4$'s is reduced. As a result of this reduction in light ends, an increase of 20 to 30 psi in hydrogen partial pressure can be attained for a fixed reactor pressure.

3) By stripping the first stage reactor effluent liquid, the concentration of the lighter boiling more paraffinic hydrocarbon fractions is reduced. Typically, 80–90% of the naphtha range boiling fractions (ie. $C_5$–350° F.) and 30–45% of the atmospheric gas oil range boiling fractions (ie. 350–360° F.) can be stripped out.

4) As a result of the strip-out of light ends resulting in an increase in hydrogen partial pressure, and the reduction in concentration of the lighter boiling more paraffinic hydrocarbon constituents in the second stage reactor feed, the sediment formation, as typically measured by the Shell Hot Filtration Test (SMS-2696), is reduced for a given level of residuum conversion. Alternatively, for a given unconverted residue product sediment specification and/or limits on reactor heavy oil sediment, as constrained by reactor operability, residuum conversion can be increased 2 to 4%.

5) The introduction of 5 to 10% of an aromatic solvent, such as cat cracker heavy cycle oil or decant oil, preferentially into the third or second reactor of a series of ebullated or fixed bed reactors, reduces the sediment formation, as measured by SMS-2696, by 0.1 to 0.2 wt. % for a given level of residuum conversion. As a result, for a given unconverted residue product sediment specification and/or reactor heavy oil sediment limits, residuum conversion can be increased 3 to 5%. Alternatively, for given unconverted product sediment and residuum conversion levels, the catalyst replacement rate can be reduced 10 to 20%.

6) The further introduction of this aromatic solvent into the liquid pool in the bottom of the stripper acts to quench the liquid pool therein, reducing the coke formation rate of the fluid and build-up of coke in the stripper sump. Coke build-up in reactor effluent separators downstream of a series of ebullated bed reactors has been known to limit unit run lengths, causing the premature turnaround of the unit.

7) Finally, the introduction of 10 to 20% of the heavy high boiling residuum feed directly into the second reactor, also acts to reduce sediment formation by increasing the resin to asphaltene concentration ratio in the liquid phase in this reactor. As a result, residuum conversion levels can be increased an additional 2 to 3%. As with the aromatic solvent, injection of this fluid into the stripper sump also acts to reduce coke formation in the liquid pool by quenching the liquid therein. Further, the introduction of unconverted resin acts to redissolve sediment which has been formed as a result of hydrocracking the residuum in the first reactor.

What is claimed is:

1. A method of hydrocracking a high boiling hydrocarbon feedstock comprising the steps of:

a. partially hydrocracking said feedstock comprising contacting said feedstock with hydrogen in a first reactor containing an ebullating bed of catalyst particles thereby forming an effluent mixture of $C_4$-light ends and lower boiling hydrocarbons and higher boiling hydrocarbons;

b. passing said partially hydrocracked effluent mixture from said first reactor into a separation/stripping zone at a pressure in the range of 1500 to 3000 psig and separating therein said partially hydrocracked effluent mixture into a vapor portion containing $C_4$-light ends and lower boiling hydrocarbons and a liquid portion containing higher boiling hydrocarbons and concurrently stripping therein said higher boiling liquid portion with hydrogen to separate an additional vapor portion containing additional $C_4$-light ends and lower boiling hydrocarbons and produce a combined vapor stream containing said vapor portion and said additional vapor portion and produce a stripped liquid stream containing more concentrated higher boiling hydrocarbons;

c. further hydrocracking said stripped liquid stream comprising contacting said stripped liquid stream with hydrogen in a second reactor containing an ebullating bed of catalyst particles thereby forming a further effluent stream containing additional lower boiling hydrocarbons and the remaining unconverted higher boiling hydrocarbons;

d. combining said combined vapor stream from step b and said further effluent stream from step c; and e. separating said combined streams from step d into a plurality of hydrocarbon product streams.

2. A method as recited in claim 1 and further including the step of blending a liquid selected from an aromatic solvent and a portion of said feedstock and combinations thereof with said stripped liquid stream.

3. A method as recited in claim 1 wherein said lower boiling hydrocarbons boil below about 650° F. and said higher boiling hydrocarbons boil above about 650° F.

4. A method as recited in claim 1 wherein said separating/stripping zon is contained in vessel which contains a liquid/vapor contact section.

* * * * *

UNITED STATES PATENT AND TRADEMARK OFFICE

CERTIFICATE OF CORRECTION

PATENT NO. : 6,454,932 B1
DATED : September 24, 2002
INVENTOR(S) : Baldassari et al.

It is certified that error appears in the above-identified patent and that said Letters Patent is hereby corrected as shown below:

Column 6,
Line 18, delete “zon” and insert -- zone -- therefore.
Line 18, insert -- a -- between the terms “in” and “vessel”.

Signed and Sealed this

Third Day of June, 2003

JAMES E. ROGAN
*Director of the United States Patent and Trademark Office*